United States Patent [19]

Lonati

[11] Patent Number: 4,719,768

[45] Date of Patent: Jan. 19, 1988

[54] CIRCULAR KNITTING MACHINE, IN PARTICULAR FOR HOSE KNITTING, WITH CONTINUOUS CYCLE LUBRICATION

[75] Inventor: Francesco Lonati, Brescia, Italy

[73] Assignee: LONATI S.p.A., Brescia, Italy

[21] Appl. No.: 805,004

[22] Filed: Dec. 5, 1985

[30] Foreign Application Priority Data

Dec. 10, 1984 [IT] Italy ..... 23970 A/84

[51] Int. Cl.[4] ..... D04B 35/28

[52] U.S. Cl. ..... 66/8; 66/115; 184/6

[58] Field of Search ..... 66/8, 115; 184/6, 6.18

[56] References Cited

U.S. PATENT DOCUMENTS

| | | | |
|---|---|---|---|
| 1,148,871 | 8/1915 | Steber | 66/8 |
| 1,514,499 | 11/1924 | Berdon | 66/8 |
| 2,556,007 | 6/1951 | Slagle | 66/8 |
| 2,707,872 | 5/1955 | McDaniel, Sr. | 66/8 |
| 2,918,986 | 12/1959 | Leipert | 184/6.18 |
| 3,326,423 | 6/1967 | Clark | 184/6 X |
| 3,481,431 | 12/1969 | Dorsey | 66/8 X |
| 3,500,661 | 3/1970 | Kohler et al. | 66/8 |
| 3,802,223 | 4/1974 | Wright et al. | 66/8 |
| 3,817,058 | 6/1974 | Lombardi | 66/8 |

FOREIGN PATENT DOCUMENTS

| | | | |
|---|---|---|---|
| 2449152 | 10/1980 | France | 66/8 |

*Primary Examiner*—Wm. Carter Reynolds

*Attorney, Agent, or Firm*—Guido Modiano; Albert Josif

[57] ABSTRACT

The machine comprises: a space defined between the needle cylinder and cylinder holder, and in communication with the delivery conduit of a feed pump, delivery ports defined on the needle cylinder for connecting the space to the outside, a collector pan located in the proximity of the needle cylinder base and supplying an oil collecting case in communication with the feed conduit of the cited pump. The delivery conduit is in communication with the cited space through the needle cylinder bearing and the oil collecting case houses the gear train for transmitting the rotary motion to the needle cylinder. The delivery ports are provided on the bottom of the needle cylinder flutes which accommodate the needles and jacks. Thus, thorough and continuous lubrication of the machine main members is achieved.

6 Claims, 6 Drawing Figures

CIRCULAR KNITTING MACHINE, IN PARTICULAR FOR HOSE KNITTING, WITH CONTINUOUS CYCLE LUBRICATION

BACKGROUND OF THE INVENTION

This invention relates to a circular knitting machine, in particular for hose knitting, with continuous cycle lubrication.

Hose knitting machines are known wherein lubrication of the main members such as gears, needles, needle cylinder, cylinder holder, is accomplished by means of dispensing nozzles fed from metering devices located in the proximity of these surfaces which require lubrication and operated as required by a machine control. These dispensing nozzles can be connected to one or more pumps and are actuated either individually or in sets according to the machine operating conditions.

As the knitting rate of these machines increases, the lubrication provided by such devices has shown a number of drawbacks. In order to dissipate the heat generated, on account of the friction, it is necessary to pump an increasingly larger amount of oil. In particular in connection with the needle cylinder, the needles and respective flutes wherein they slide must be sprinkled continuously to simultaneously provide an effective lubrication and good removal of heat. The high speed of the needle cylinder resists, however, the contact of the oil with the mechanical members to be lubricated in that, owing to the centrifugal force, the oil is thrown outwards almost instantaneously.

To obviate this drawback, highly viscous oils have been tried unsuccessfully because a lower heat removal is obtained.

SUMMARY OF THE INVENTION

It is the primary aim of this invention to provide a knitting machine, in particular for hose knitting, which can overcome the above drawbacks realizing a machine with continuous cycle lubrication so as to ensure optimum reduction of frictions and a high rate of heat removal.

Within this aim, it is an object of the invention to eliminate the combination of dispensers, metering devices, and drives present in prior type machines.

This aim, and these and other objects to become apparent hereinafter, are achieved by a circular knitting machine, in particular for hose knitting, with continuous cycle lubrication, characterized in that it comprises: a space defined between the needle cylinder and cylinder holder and in communication with the delivery conduit of a feed pump, delivery ports defined on said needle cylinder for connecting said space with the outside, a collector pan located in the proximity of the base of said needle cylinder and supplying an oil collecting case in communication with the feed conduit of said pump.

BRIEF DESCRIPTION OF THE DRAWINGS

Further features and advantages of the invention will be apparent from the description of a preferred, though not exclusive, embodiment of the machine of this invention, as illustrated by way of example and not of limitation in the accompanying drawings, where.

DESCRIPTION OF THE PREFERRED EMBODIMENTS

Figures 1, 5, 6:
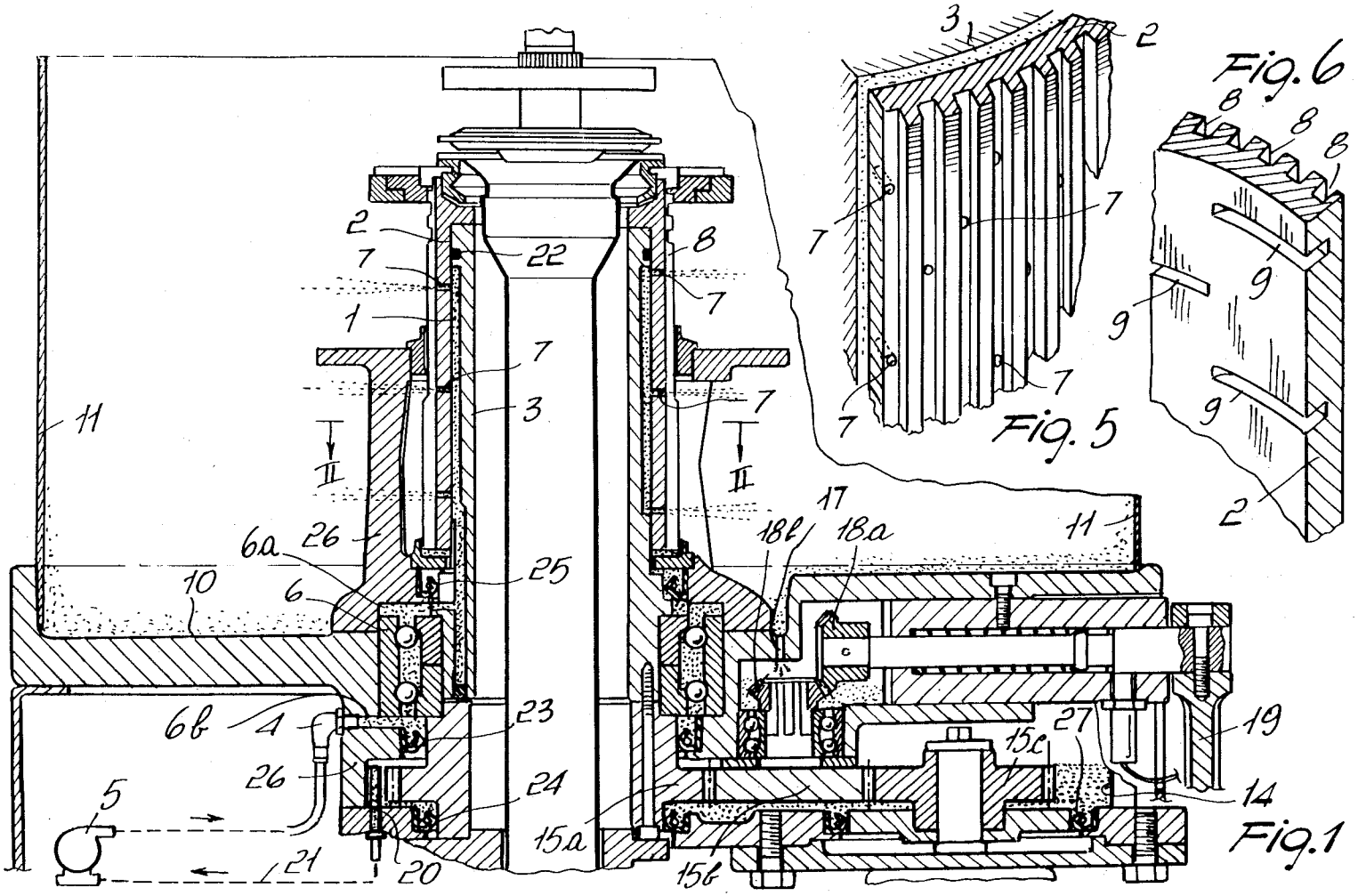
FIG. 1 is a section taken on a vertical plane of the upper portion of a machine according to the invention with the lower portion omitted for clarity.
FIGS. 5 and 6 are perspective views showing details of the needle cylinder in a machine according to the invention.
Figure 3:
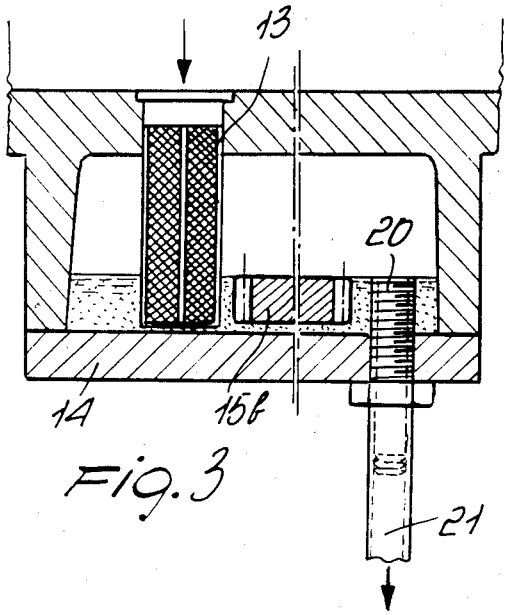
FIG. 3 is a section of FIG. 2 along the line III—III.
Figure 4:
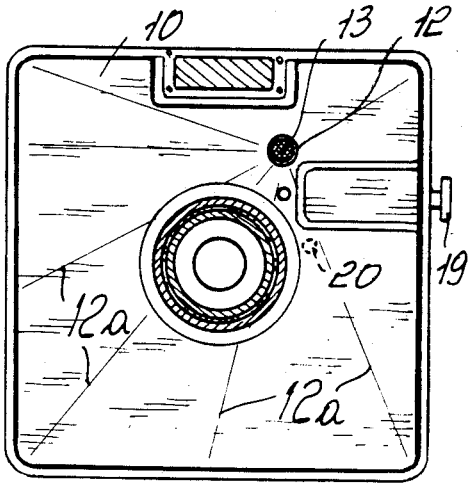
FIG. 4 is a reduced view of the collector pan according to the invention.

With reference to the drawing figures, the machine of this invention comprises a space 1 defined between the needle cylinder 2 and cylinder holder 3 and in communication byway of conduit means 6a and 6b with the delivery conduit 4 of a feed pump 5 through the bearing 6 carrying the needle cylinder slidably. The space 1 extends circumferentially of the cylinder holder and is formed on the outer surface of the cylinder holder.

The space 1 is in communication with the outside through duct means such as delivery ports 7 which cross the needle cylinder and open at the bottom surfaces of the flutes 8 in which the needles and jacks are housed. It will be understood that the flutes 8 with the needles and jacks therein define surface portions to be lubricated at an outside peripheral portion of the needle cylinder 2.

These delivery ports may be formed by drilling the needle cylinder as shown in FIG. 5 or more quickly by means of a plurality of milling sections 9 inclined to the flutes 8 and formed on the inner peripheral surface of the needle cylinder at mutually different levels to intersect the bottom of the flutes 8, to define the delivery ports 7, as shown in FIG. 6.

The machine, according to the invention, also comprises a collector pan 10 located in the proximity of the needle cylinder base to receive the oil which flows out of the delivery ports. At the outer edges of the collector pan 10 there are provided guard walls 11 which extend over the full height of the needle cylinder and prevent oil from splashing out of the machine. In general, these walls are made of a transparent material to enable the operator to observe the machine knitting.

On the collector pan there is provided a passage hole 12 which is fully occupied by a filter 13 which communicates with an oil collecting case 14 housing a gear train, in the figures the gear wheels 15a, 15b and 15c, for transmitting the rotary motion from the machine main motor, not shown for clarity, to the needle cylinder.

In order to facilitate the conveyance of the oil collected from the collector pan to the passage hole there are provided on the bottom face of the collector pan inclines 12a converging toward the passage hole 12.

On the collector pan there is also provided a drip hole 17, of a much smaller cross-section than the passage hole, for drip conveying oil to a bevel gear pair 18a and 18b which are used for manually operating the machine through a crank lever 19.

The oil collecting case has a drain hole 20 located at a higher level at a level corresponding with the upper plane of lay of the gear train such that the gears are submerged in the oil.

Figure 2:
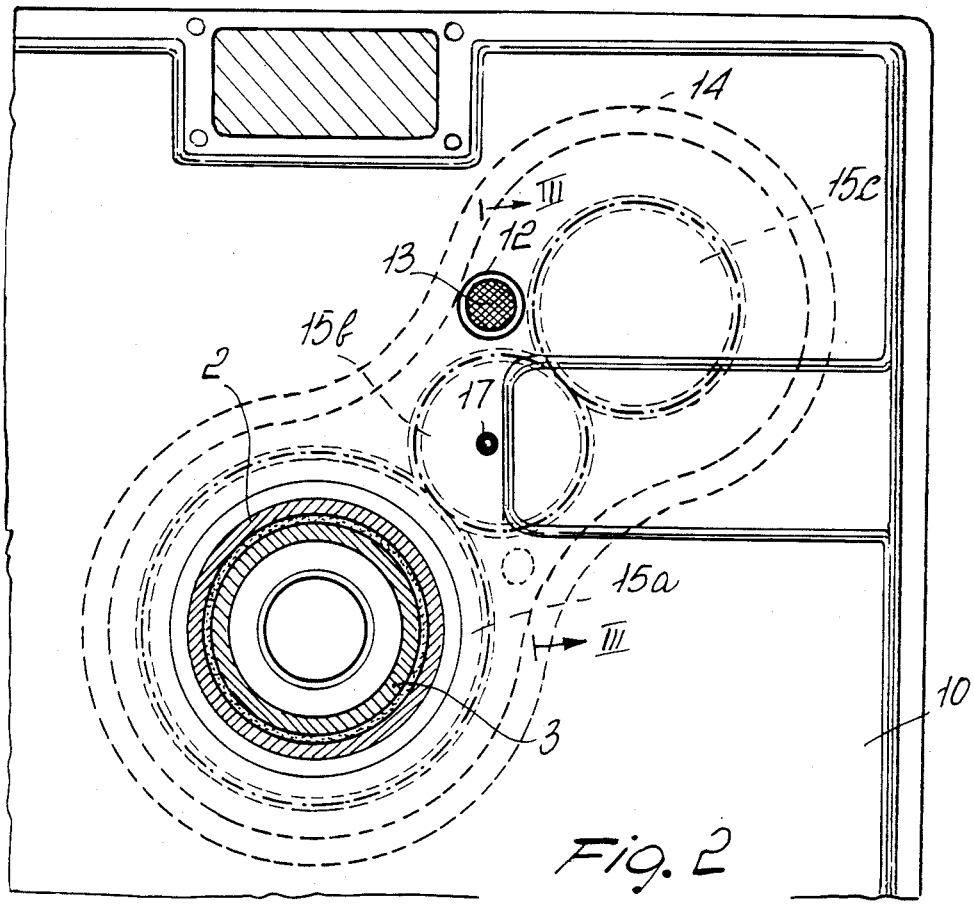
FIG. 2 is a section along the line II—II of FIG. 1.

The drain hole 20 is in communication with the feed conduit 21 of the feed pump 5. For clarity of illustration in FIG. 1 the drain hole has been shifted with respect to that shown in FIG. 2. For completeness, it should be said that the whole path of the oil is delimited by sealing elements to prevent undesired infiltrations of lubricant.

Thus for example there are provided: a gasket 22 between the cylinder and cylinder holder so as not to soil the hoses being knitted, oil scraper rings 23, 24 and 25 between the needle cylinder and the machine supporting structures 26, an oil scraper ring 27 at the entrance of the drive shaft into the oil collecting case.

The oil circulation through the machine according to the invention occurs as follows. At the start of the movement of the machine the feed pump 5 is driven and conveys oil through the bearing 6 into the space 1. Owing to the pressure the oil flows out of the delivery ports 7 and lubricates the needle cylinder flutes, the needles, and the jacks. The outflow of oil is assisted at this stage by the centrifugal force developed by the high rotational speed of the needle cylinder.

The oil is thrown outwards and falls in part onto the guard walls 11 and in part directly onto the collector pan 10, flowing down toward the passage hole 12.

In flowing through the passage hole 12 and then through the filter 13, the oil is relieved of any impurities and flows down into the oil collecting case 14 where the gears **15*a*, 15*b* and 15*c*** are dip lubricated by virtue of the provision of the drain oil.

Through the drain hole the oil is sucked up by the feed pump and the cycle is resumed.

Some of the oil which falls onto the collecting pan is conveyed through the drip hole 17 to the bevel gear pair **18*a* and 18*b*** to lubricate the gears during manual operation of the machine.

It has been found in practice that the machine according to the invention fully achieves its aim of providing an effective lubrication, and by virtue of the large mass of oil being circulated, a high removal of heat from the moving members.

Thus, moreover, the centrifugal force is utilized which accounted with prior machine for most of the problems encountered in distributing the oil.

Again owing to the centrifugal force one achieves, with the dispersion of the oil outside the needle cylinder, an effective lubrication of those members which are located in the close proximities of the needle cylinder outer surface, such as cams, needle selecting assemblies, cam assemblies, etc.

A further advantage of the lubrication of the machine from the inside to the outside according to the invention is the possibility of using highly fluid oils which afford a more effective removal of heat.

A not least advantage is that of eliminating all the oil conveying conduits, metering devices and the nozzles supplied thereby, as well as the devices for driving the metering devices and the dispensers.

The invention herein is susceptible to many modifications and changes without departing from the scope of the inventive concept; furthermore, all the details may be replaced with technical equivalents thereof.

In practicing the invention the materials used and the dimensions may be any ones contingent on requirements and the state of the art.

I claim:

1. In a circular knitting machine with continuous cycle lubification with a feed pump having a feed conduit and a delivery conduit for lubricating oil, and having a cylinder holder and a needle cylinder surrounding the cylinder holder and having surface means to be lubricated located at least on an outside peripheral portion of said needle cylinder, means defining a space beteen said needle cylinder and said cylinder holder and in communication with said delivery conduit and duct means for connecting said space with said surface means to be lubricated and wherein said needle cylinder has a base portion and wherein the knitting machine further comprises a collector pan located near said base portion and below said collector pan an oil collecting case receiving oil from said collector pan and in communication with said feed conduit of said feed pump and a gear train for transmission of rotary motion to said needle cylinder, said gear train being located in said oil collecting case.

2. A knitting machine according to claim 1, further comprising a bearing carrying said needle cylinder and conduit means providing communication between said space and said delivery conduit through said bearing.

3. A knitting machine according to claim 1, further comprising a bevel gear pair transmission arranged below said collector pan, said collector pan having a drip hole opening at said bevel gear transmission.

4. A knitting machine according to claim 1, further comprising a gear train for transmission of rotary motion to said needle cylinder, said gear train being located in said oil collecting case and having a top plane of lay therein, said oil collecting case comprising drain hole means therein, said drain hole means having a drain opening thereof arranged at a level higher than said top plane of lay.

5. In a circular knitting machine with continuous cycle lubrification with a feed pump having a feed conduit and a delivery conduit for lubricating oil, and having a cylinder holder and a needle cylinder surrounding the cylinder holder and having surface means to be lubricated located at least on an outside peripheral portion of said needle cylinder, means defining a space beteen said needle cylinder and said cylinder holder and in communication with said delivery conduit and wherein said space has a circumferential extension and is delimited inwardly by said cylinder holder and outwardly by said needle cylinder, duct means for connecting said space with said surface means to be lubricated and wherein said needle cylinder has a base portion and wherein the knitting machine further comprises a collector pan located near said base portion and below said collector pan an oil collecting case receiving oil from said collector pan and in communication with said feed conduit of said feed pump, a gear train for transmission of rotary motion to said needle cylinder, said gear train being located in said oil collecting case and having a top plane of lay therein, said oil collecting case comprising drain hole means therein, said drain hole means having a drain opening thereof arranged at a level higher than said top plane of lay.

6. A machine according to claim 5, wherein said collector pan has a passage hole providing communication with said collecting case, a filter in said passage hole and a bottom face having inclines leading towards said passage hole.

* * * * *